US006679641B1

(12) United States Patent
Allen

(10) Patent No.: US 6,679,641 B1
(45) Date of Patent: Jan. 20, 2004

(54) TOOTH BRUSH WITH RESERVOIR

(76) Inventor: Michael J. Allen, 6420 W. 4600 S., Hooper, UT (US) 84315

( * ) Notice: Subject to any disclaimer, the term of this patent is extended or adjusted under 35 U.S.C. 154(b) by 0 days.

(21) Appl. No.: 09/483,448

(22) Filed: Jan. 14, 2000

(51) Int. Cl.[7] ..... B43K 5/10
(52) U.S. Cl. ..... 401/179; 401/176; 401/270
(58) Field of Search ..... 401/153, 179, 401/171, 176, 270, 150, 155, 163

(56) References Cited

U.S. PATENT DOCUMENTS 818,000 A * 4/1906 Stevenson ..... 401/155
2,243,774 A * 5/1941 Resh ..... 401/179
2,250,758 A * 7/1941 French ..... 401/155
2,717,101 A * 9/1955 Van Handel ..... 401/171
3,417,762 A * 12/1968 Hall ..... 401/155

* cited by examiner

*Primary Examiner*—David J. Walczak
(74) *Attorney, Agent, or Firm*—Thomas E. Fehr

(57) ABSTRACT

A tooth brush with reservoir having a body that is releasably attached to a head with the bristles. Releasable attachment of the body is accomplished with an aperture that also serves for dispensing tooth paste from a reservoir within the body. A blade within the body is attached to a tab outside the body with a stem that passes through a linear aperture in the body. Pushing the tab toward the aperture, thus, forces the blade toward the aperture. Consequently, when the reservoir contains tooth paste, pushing the tab toward the aperture urges tooth paste toward the aperture, eventually resulting in the dispensing of tooth paste from that aperture. Either a foldable membrane or a central partition impedes the escape of tooth paste through the linear aperture.

13 Claims, 13 Drawing Sheets

TOOTH BRUSH WITH RESERVOIR

BACKGROUND OF THE INVENTION

1. Field of the Invention

This invention relates to a tooth brush which has a reservoir for receiving, containing, and dispensing tooth paste.

2. Description of the Related Art

Numerous patents have been granted for tooth brushes which contain a reservoir for containing and dispensing tooth paste.

Examples of such patents are U.S. Pat. Nos. 818,000; 1,610,831; 1,629,905; 1,780,066; 2,793,792; 2,795,000; 3,261,367; 4,615,635; 5,584,593; 5,636,933; 5,746,532; 5,846,010; and 5,908,257.

In the devices associated with each of these patents, however, tooth paste is forced from the reservoir, through one or more relatively small channels, to the base of the bristles. Such small channels can easily become partially or completely clogged with dried tooth paste, thereby impeding the dispensing function of the tooth brush. Moreover, these channels dispense the tooth paste near the end of the bristles that is attached to the tooth brush, which is a less effective location for applying the tooth paste to a user's teeth than the end of the bristles opposite to the end that is attached to the tooth brush.

The tooth brush of U.S. Pat. No. 5,882,134 dispenses the tooth paste into a trough, which creates an additional, somewhat bulky appendage to the tooth brush. And a rather complicated moveable tube is utilized to dispense the tooth paste onto the bristles in U.S. Pat. No. 5,911,532.

SUMMARY OF THE INVENTION

The head of the present tooth brush is removably attached to the body of the present invention.

Except for being removably attached to the body of the tooth brush, the head is the same as the traditional head for a tooth brush. The body of the tooth brush contains a reservoir for storing tooth paste.

An aperture which assists in removably attaching the head of the tooth brush to the body of the tooth brush also is available for inserting tooth paste into the reservoir. And when it is desired to dispense tooth paste onto the bristles of the tooth brush, the head is detached from the body; the aperture is placed near the end of the bristles that is not attached to the head, just as is the aperture of a traditional tube of tooth paste; and an exterior tab is used to cause a blade in the reservoir to force tooth paste through the reservoir onto the end of the bristles that is not attached to the head. Not only is this location for the tooth paste the same location that is utilized when a standard tube of tooth paste is employed, but this location is also the most effective position on the bristles for applying tooth paste to the user's teeth.

Furthermore, because the aperture is not located between bristles, such aperture can be significantly larger and less likely to be clogged with dried tooth paste. Additionally, the aperture is readily accessible for being cleaned of any dried tooth paste that may accumulate near the aperture.

DESCRIPTION OF THE PREFERRED EMBODIMENT

The Tooth Brush with Reservoir is, as its name implies, a tooth brush which contains a reservoir which can be filled with tooth paste.

Figure 1:
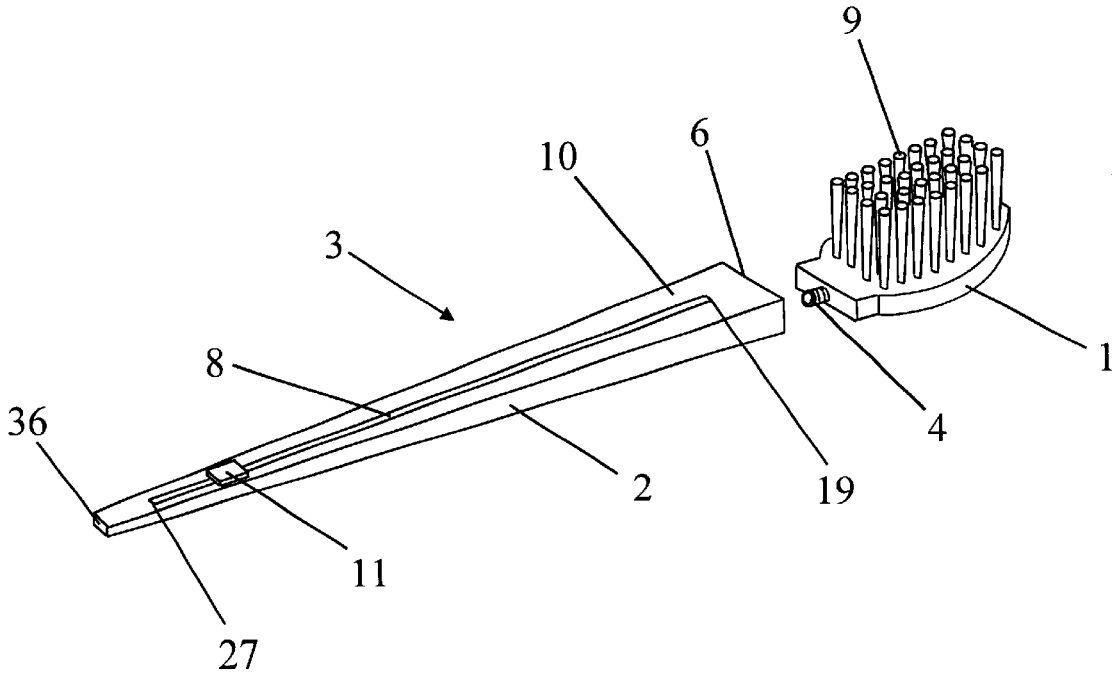
FIG. 1 is an isometric view of the Tooth Brush with Reservoir where the head of the Tooth Brush has been removed from the body of the Tooth Brush.

As shown in FIG. 1, the head 1 is removably attached to the body 2 of the tooth brush 3. This is preferably accomplished with a male fitting 4 which mates with an aperture 5 in a first end 6 of the body 2 of the tooth brush. Preferably, the male fitting 4 and the aperture 5 have screw threads so that the male fitting 4 can be screwed into the aperture 5. While being removable from the head 1, the body 2 must, during the brushing operation, remain securely attached to the head 1.

Figure 2:
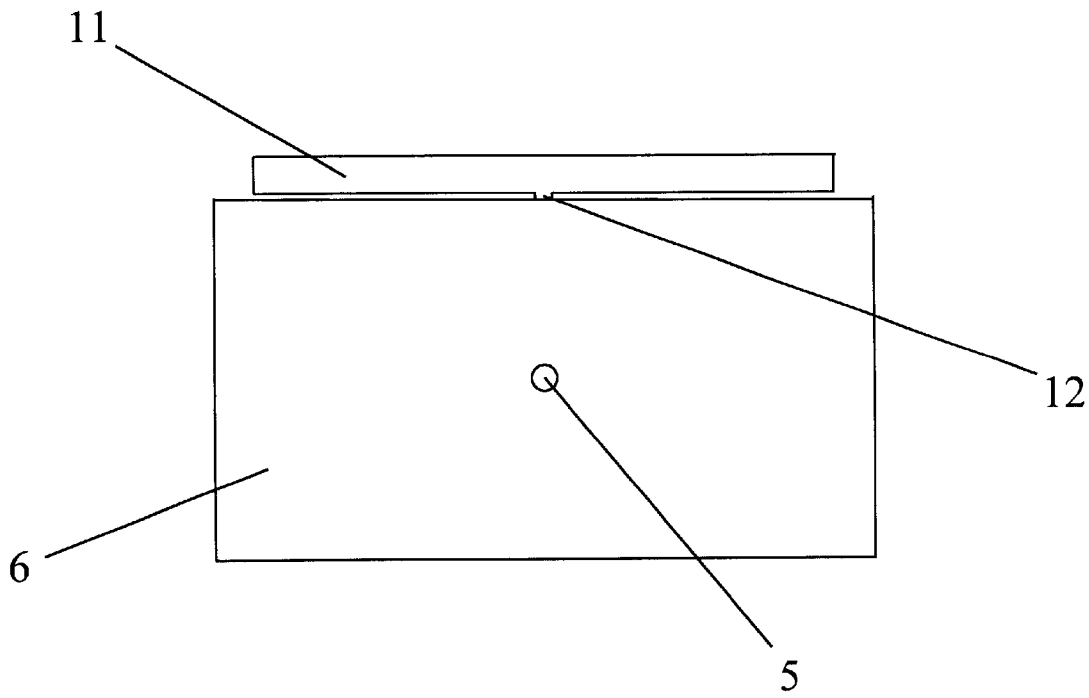
FIG. 2 is a view looking at the first end of the body of the Tooth Brush, i.e., the end of the body of the Tooth Brush which to which the head of the Tooth Brush removably attaches.

Through the aperture 5, which is depicted in FIG. 2, tooth paste is placed into and withdrawn from the reservoir 7 formed within the body 2 of the tooth brush 3.

The body 2 of the tooth brush 3 contains a linear aperture 8 communicating with said reservoir 7, which linear aperture 8 is preferably on the same side of the body 2 as the bristles 9 are on the head 1 when the head 1 has been attached to the body 2, which side is designated the top 10 of the body 2. A tab 11 is slidably mounted within the linear aperture 8.

Figure 3:
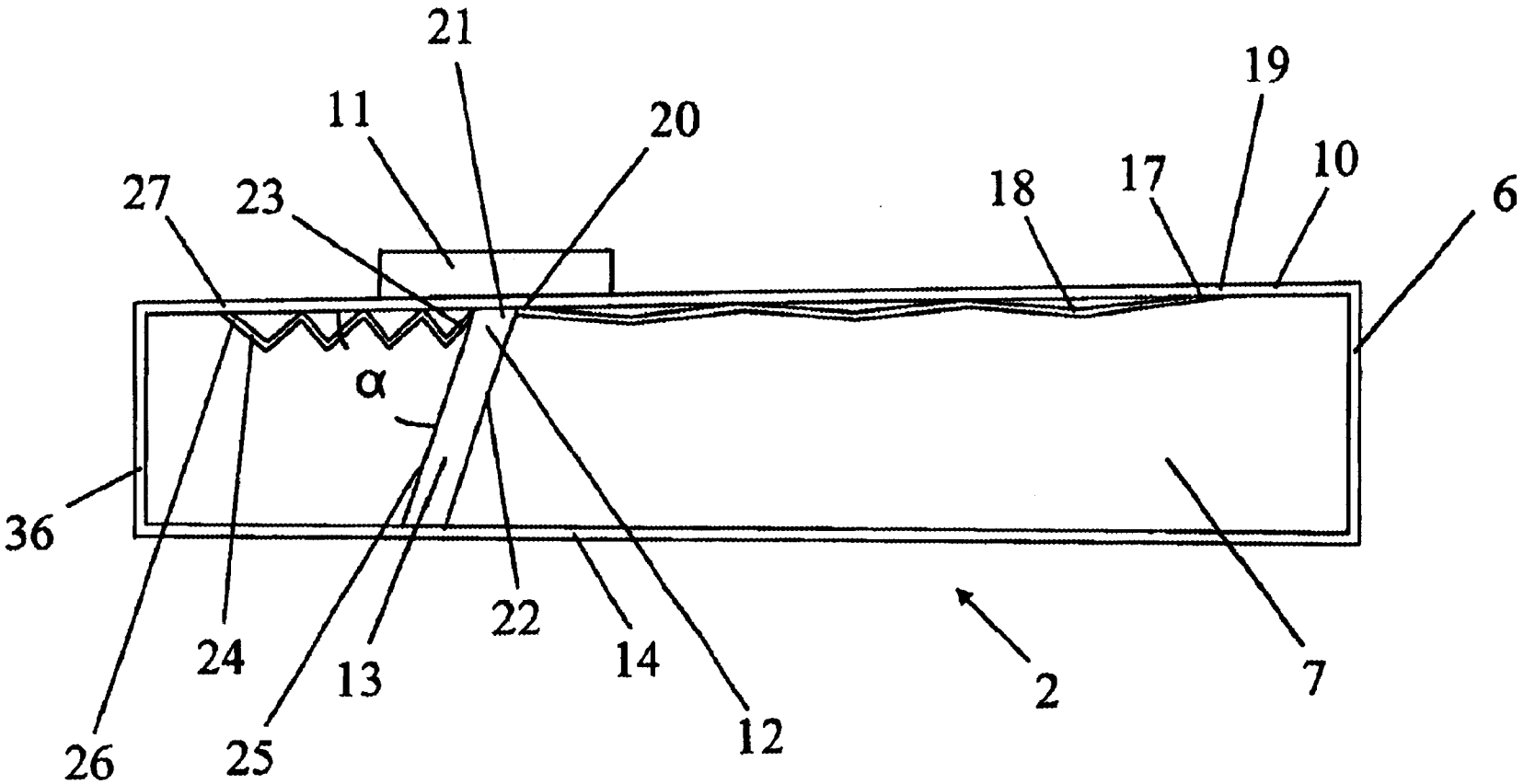
FIG. 3 is a lateral view of the body of the Tooth Brush.

Attached to the tab 11 is a stem 12 which, as shown in FIG. 3, passes through the linear aperture 8 before connecting to a blade 13 which is preferably constructed of resilient material. The blade 13 is preferably angled so that, when it is constructed of resilient material, the angle $\alpha$ will increase as the tab 11 is pushed toward the aperture 5 so that the blade 13 will always run from the top 10 of the body 2 to the bottom 14 of the body 2, even when the height of the body 2 increases as the aperture 5 is approached.

Figure 4:
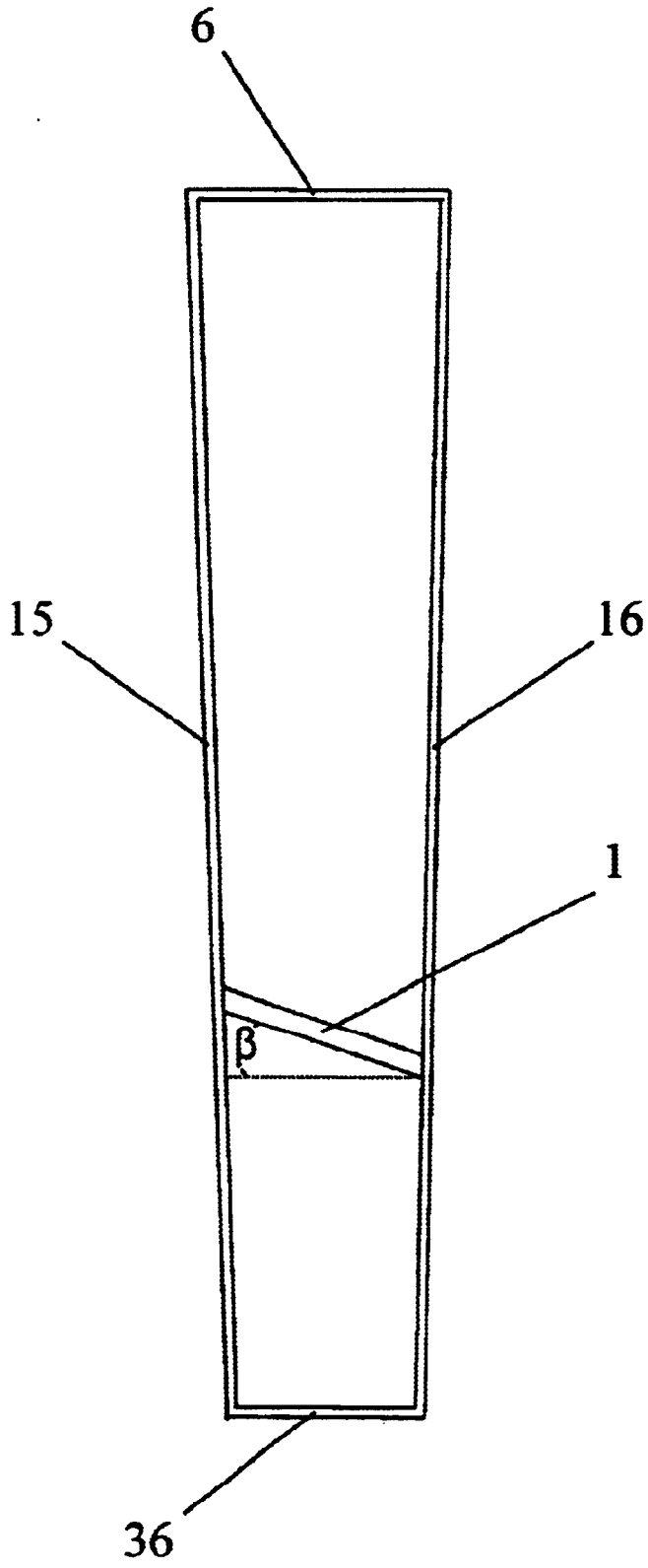
FIG. 4 is a view from above the body of the Tooth Brush.

Similarly, as shown in FIG. 4, which is a view from above the body 2, the blade 13 is angled between the first side 15 and the second side 16 of the body 2. The enables the angle β to decrease as the tab 11 is pushed toward the aperture 5 so that the blade 13 will always touch both the first side 15 and the second side 16 of the body 2, even when the width of the body 2 increases as the aperture 5 is approached.

Having the blade 13 always run from the top 10 of the body 2 to the bottom 14 of the body 2 and always touch both the first side 15 and the second side 16 of the body 2 assures that tooth paste will not be able to bypass the blade 13 as such blade 13 is pushed toward the aperture 5.

The possibility of having tooth paste escape through the linear aperture 8 is minimized through several techniques.

As illustrated in FIG. 3, a first end 17 of a first foldable membrane 18 is attached to the top 10 of the body 2 near a first end 19 of the linear aperture 8; a second end 20 of the first foldable membrane 18 is connected to the blade 13 near the top 21 of such blade 13 and on a first side 22 of such blade 13. A first end 23 of a second foldable membrane 24 is attached to the blade 13 near the top 21 of such blade 13 and on a second side 25 of such blade 13; a second end 26 of the second foldable membrane 24 is attached to the top 10 of the body 2 near a second end 27 of the linear aperture 8. Thus, as the tab 11 is pushed toward the aperture 5, the first foldable membrane 18 folds; and the second foldable membrane 24 unfolds. Conversely, as the tab 11 is pulled away from the aperture 5, the first foldable membrane 18 unfolds; and the second foldable membrane 24 folds. This assures that the linear aperture 8 is continuously sealed. (If desired, there could be a single foldable membrane having, at an intermediate point between a first end and a second end, an aperture through which the stem 12 would pass and by which the foldable membrane would be attached to the stem 12.)

Figure 13:
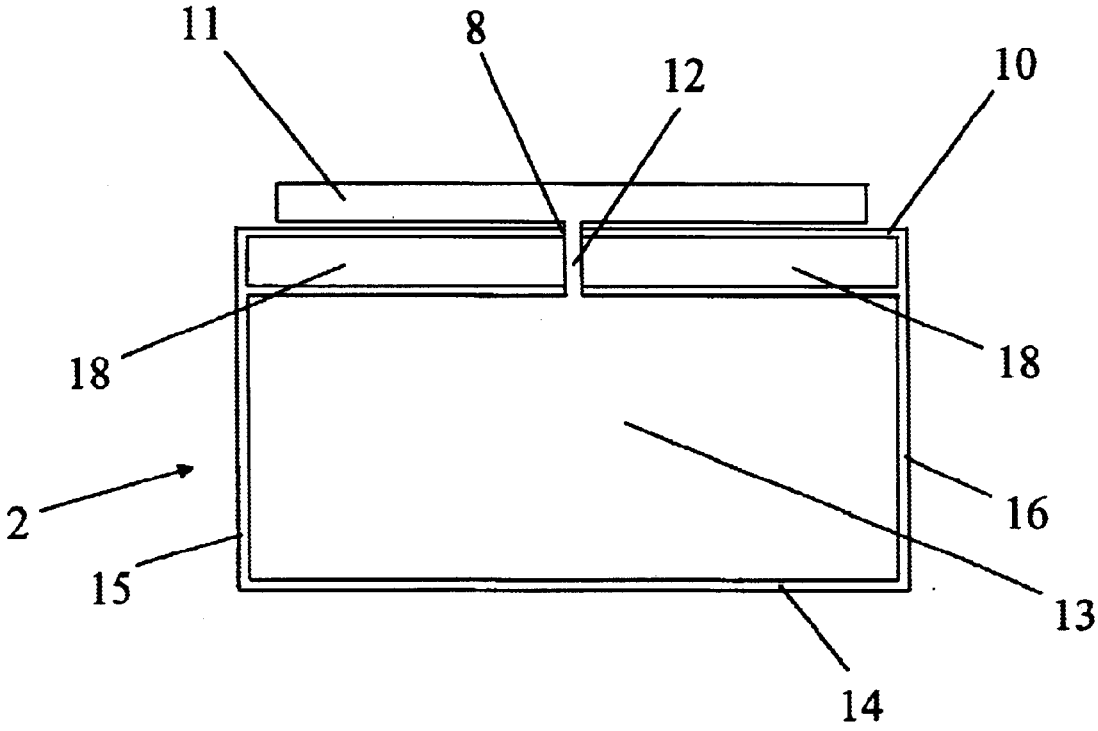
FIG. 13 shows the foldable membrane running from the first side to the second side of the body of the tooth brush as viewed from the first end of the body of the tooth brush.
Figure 14:
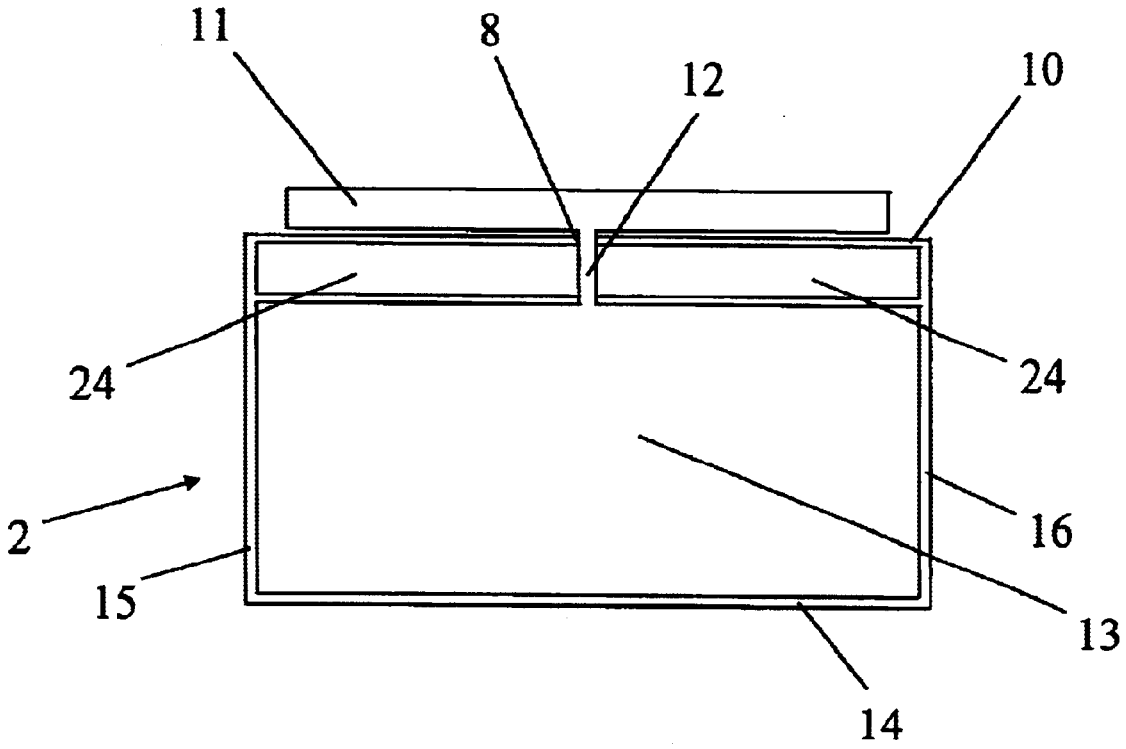
FIG. 14 shows the foldable membrane running from the first side to the second side of the body of the tooth brush as viewed from the second end of the body of the tooth brush.

Preferably, as illustrated in FIG. 13 and FIG. 14, to reduce the possibility that tooth paste can leak around the first foldable membrane 18 and the second foldable membrane 24, the first foldable membrane 18 and the second foldable membrane 24 run from the first side 15 to the second side 16 of the body 2 when the width of the body 2 does not change.

Figure 5:
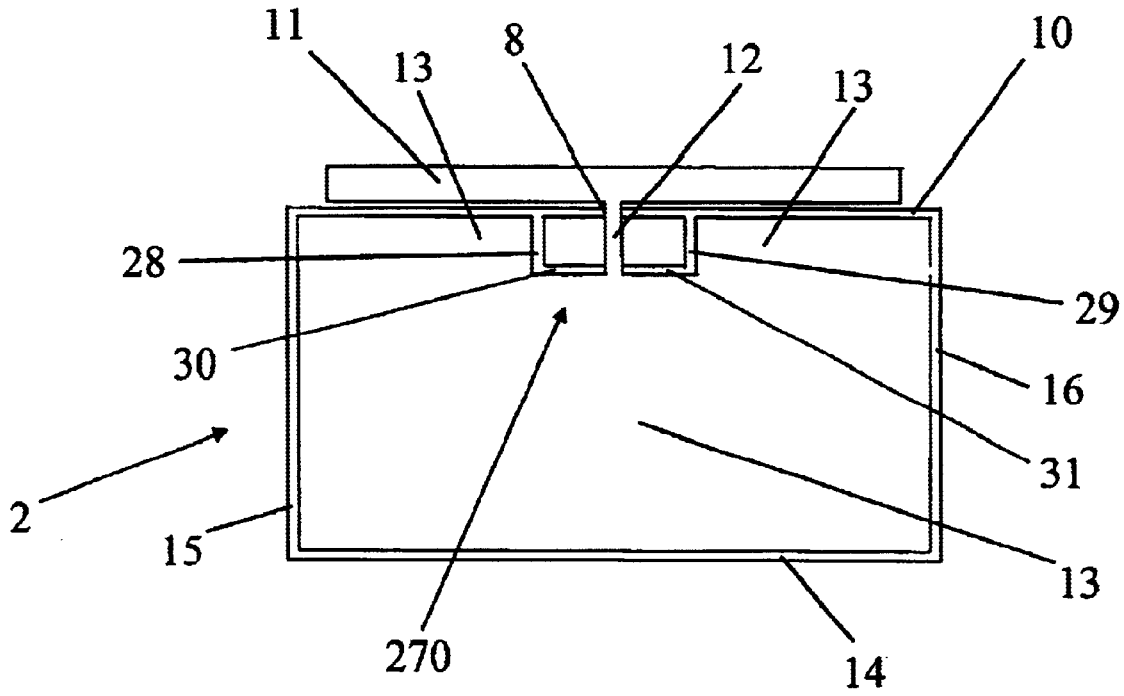
FIG. 5 is a cross-sectional view for the body of the Tooth Brush showing a channel which is incorporated when the width of the body of the Tooth Brush changes.

When the width of the body 2 does, however, change, a membrane-holding channel 270, as illustrated in FIG. 5, is placed along the linear aperture 8. A first wall 28 is attached to the top 10 of the body 2 between the first side 15 of the body 2 and the linear aperture 8 and runs toward the bottom 14 of the body 2. A second wall 29 is attached to the top 10 of the body 2 between the second side 16 of the body 2 and the linear aperture 8 and runs toward the bottom 14 of the body 2. The first wall 28 terminates and is connected to a first projection 30 before the first wall 28 reaches the bottom 14 of the body 2. The first projection 30 runs from the first side 15 of the body 2 approximately parallel to the top 10 of the body 2 until reaching a position below the side of the linear aperture 8 that is nearer to the first side 15 of the body 2. Similarly, the second wall 29 terminates and is connected to a second projection 31 before the second wall 29 reaches the bottom 14 of the body 2. The second projection 31 runs from the second side 16 of the body 2 approximately parallel to the top 10 of the body 2 until reaching a position below the side of the linear aperture 8 that is nearer to the second side 16 of the body 2. (If desired, the first wall 28 and the second wall 29 could be eliminated if, as portrayed in FIG. 6, the first projection 30 is connected to the first side 15 of the body 2 and if the second projection 31 is attached to the second side 16 of the body 2.)

Figure 6:
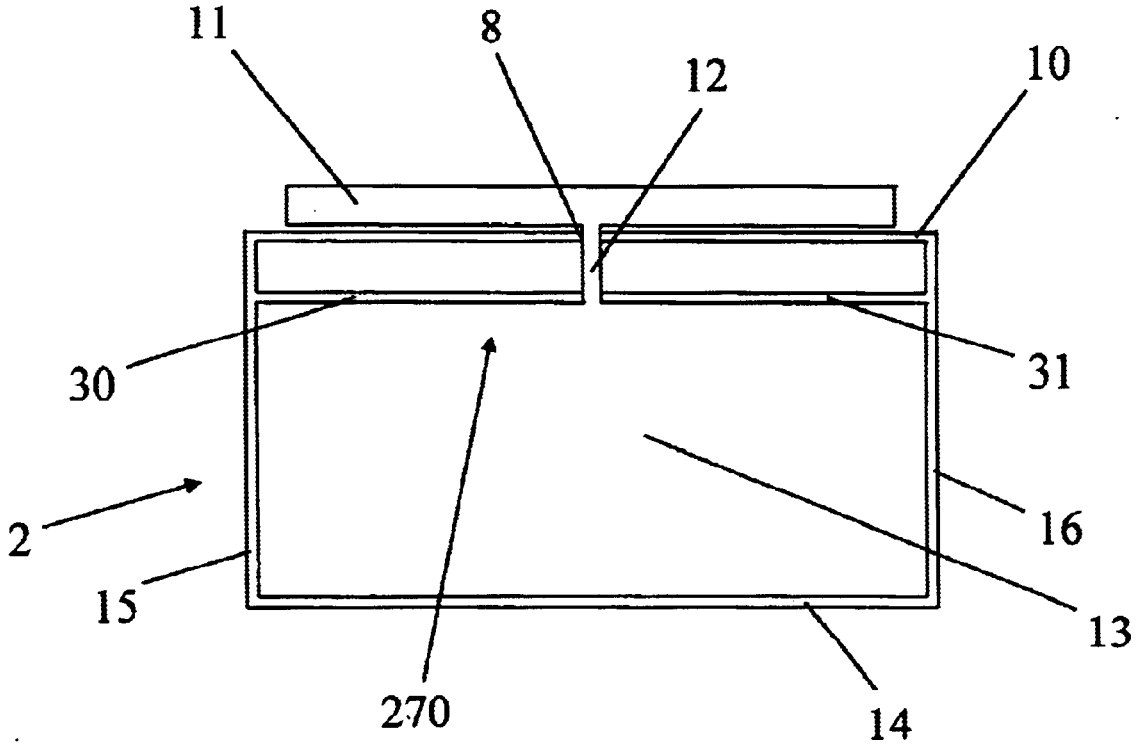
FIG. 6 is a cross-sectional view, similar to that of FIG. 5, where the channel extends across the full width of the body of the Tooth Brush.
Figure 7:
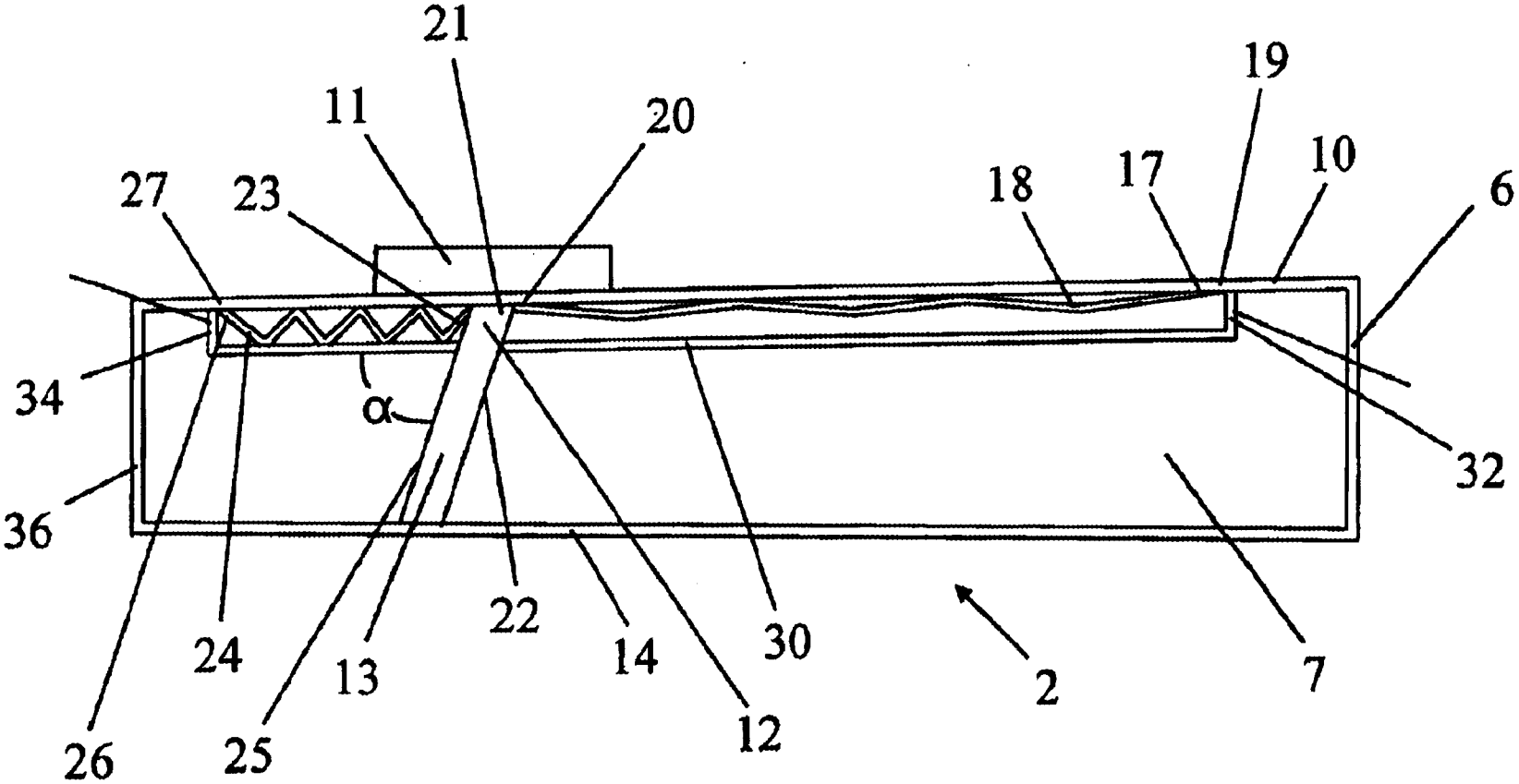
FIG. 7 is a lateral view of the embodiments of FIG. 5 and FIG. 6.

When a first projection 30 and a second projection 31 are employed, the stem 12 must be continued—as shown in FIG. 5, FIG. 6, and FIG. 7, until the stem 12 has extended beyond the first projection 30 and the second projection 31, the blade 13 must incorporate cutouts to accommodate the first projection 30 and the second projection 31, or the stem 12 must be extended and the blade 13 must incorporate a cutout to accommodate as depicted in FIG. 6.

Figure 12:
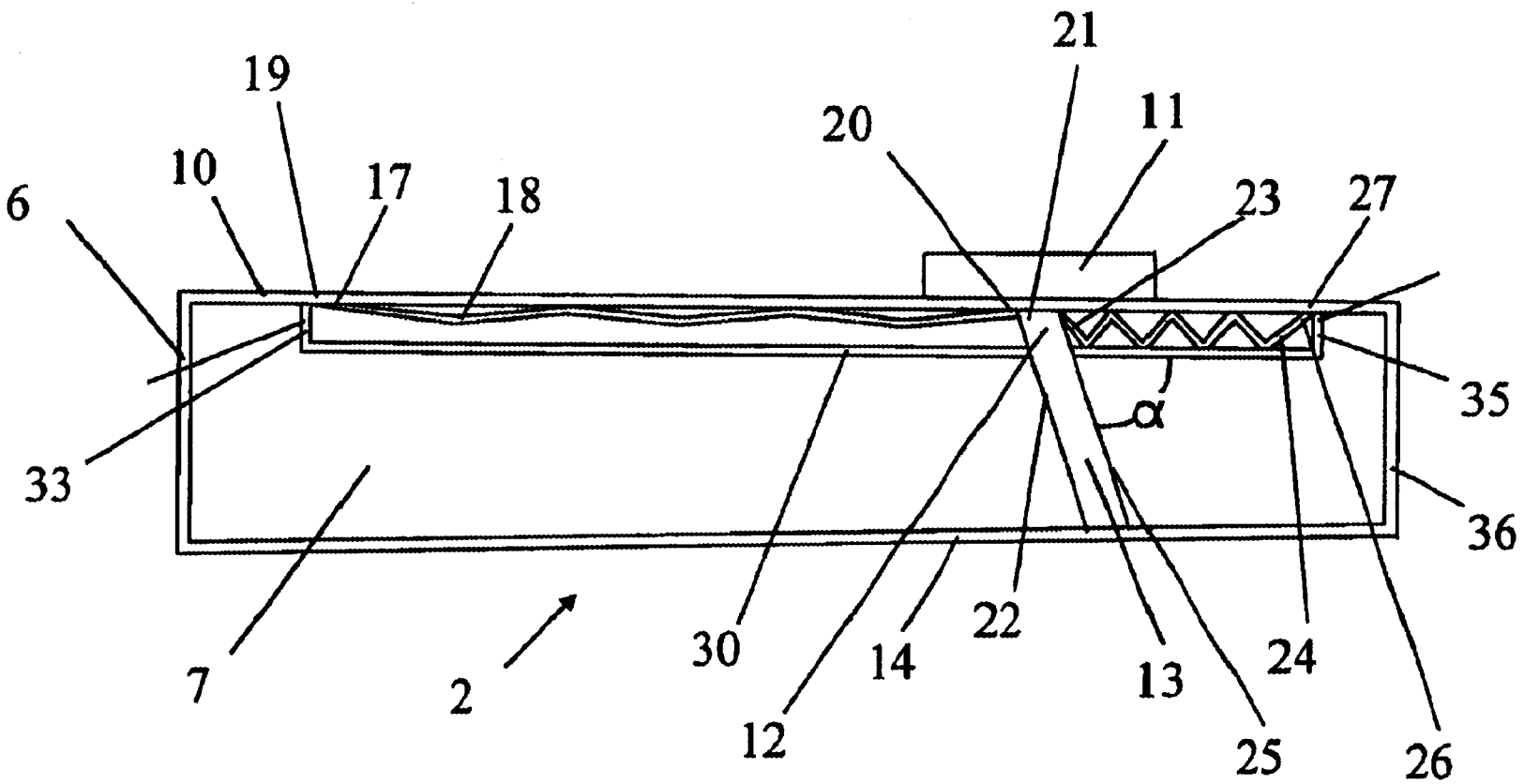
FIG. 12 shows the embodiment of FIG. 7 from the opposite side.

As illustrated in FIG. 7 and FIG. 12, the first end 32 of the first wall 28 and the first end 33 of the second wall 29 are located toward the first end 6 of the body 2 beyond the first end 19 of the linear aperture 8. In fact, the first end 32 of the first wall 28 and the first end 33 of the second wall 29 may extend to the first end 6 of the body 2.

The second end 34 of the first wall 28 and the second end 35 of the second wall 29 are located beyond the second end 27 of the linear aperture 8 toward the end of the body 2 that is away from the aperture 5 and that is designated the second end 36 of the body 2. In fact, the second end 34 of the first wall 28 and the second end 35 of the second wall 29 may extend to the second end 36 of the body 2.

If the first end 32 of the first wall 28 and the first end 33 of the second wall 29 do not reach the first end 6 of the body 2, a first end plate 37 is attached to the first end 32 of the first wall 28, to the first end 33 of the second wall 29, to the top 10 of the body 2, to the first projection 30, and to the second projection 31.

Similarly, if the second end 34 of the first wall 28 and the second end 35 of the second wall 29 do not reach the second end 36 of the body 2, a second end plate 38 is attached to the second end 34 of the first wall 28, to the second end 35 of the second wall 29, to the top 10 of the body 2, to the first projection 30, and to the second projection 31.

Figure 8:
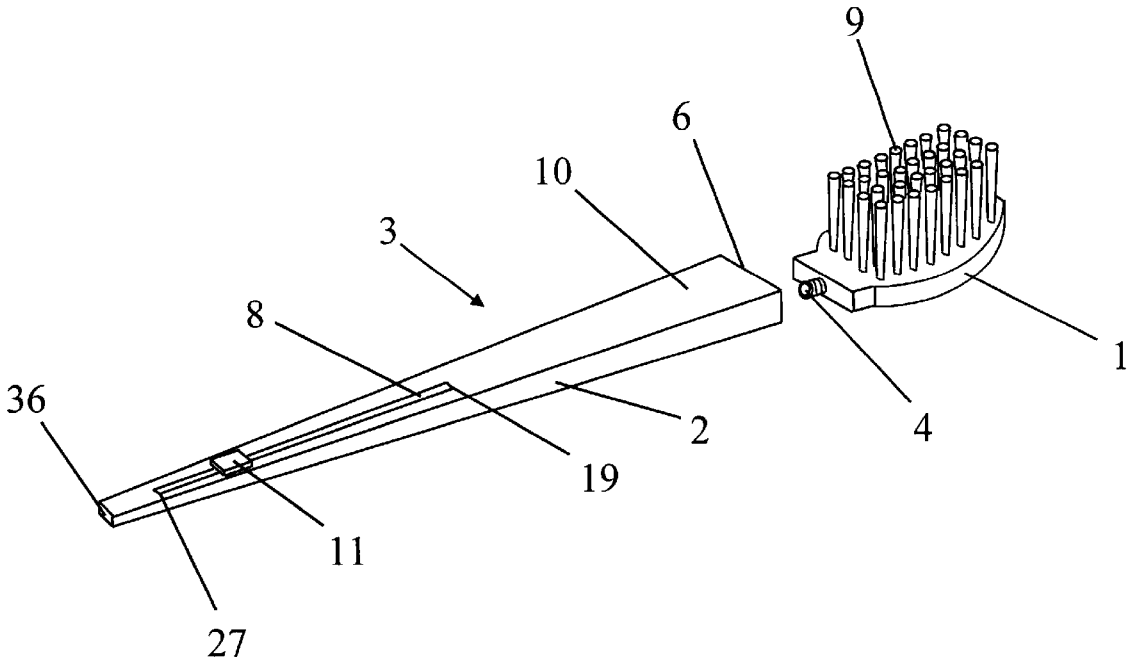
FIG. 8 is an isometric view of an alternate embodiment of the Tooth Brush with Reservoir where the linear reservoir does not extend under the linear aperture.
Figure 9:
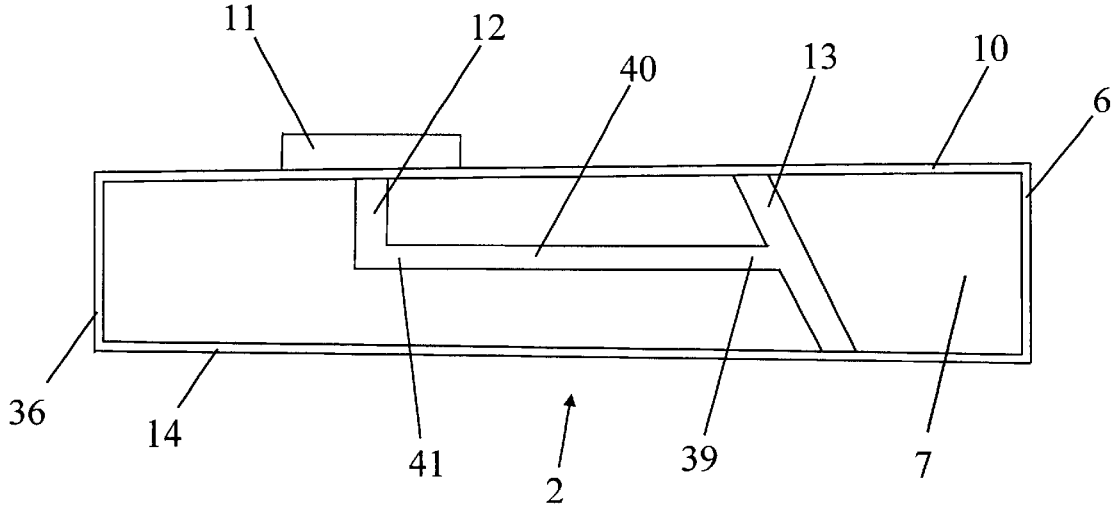
FIG. 9 is a lateral view of the embodiment of FIG. 8.
Figure 10:
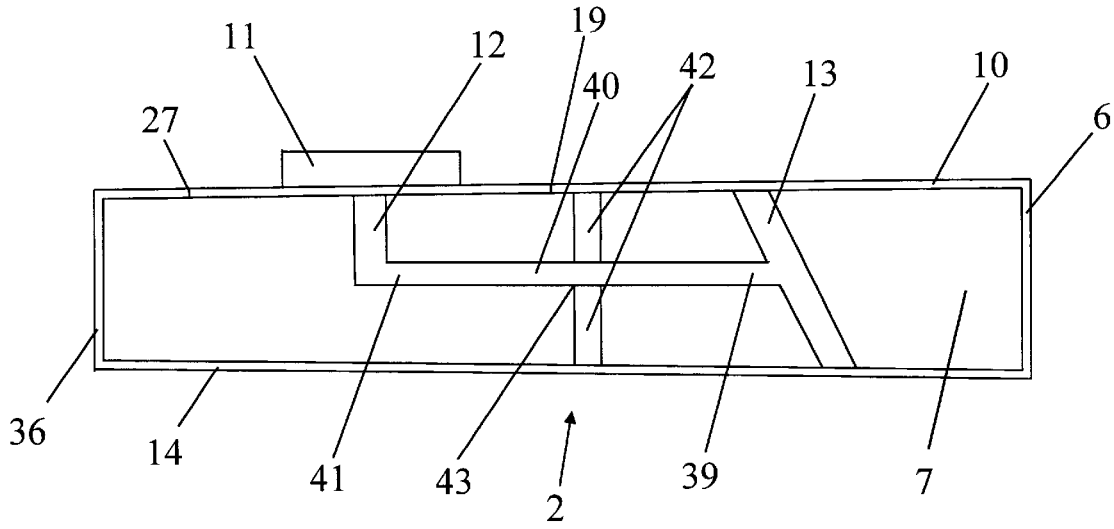
FIG. 10 is a lateral view of an embodiment similar to that of FIG. 8 but which also includes a central partition.

An alternative embodiment of the Tooth Brush with Reservoir is illustrated in FIG. 8, FIG. 9, and FIG. 10. In this embodiment the blade 13 is attached to a first end 39 of a rod 40; a second end 41 of the rod 40 is connected to the stem 12 inside the body 2. The length of the rod 40 is selected such that when the stem 12 is at the second end 27 of the linear aperture 8, the top 21 of the blade 13 is between the first end 19 of the linear aperture 8 and the first end 6 of the body 2.

Figure 11:
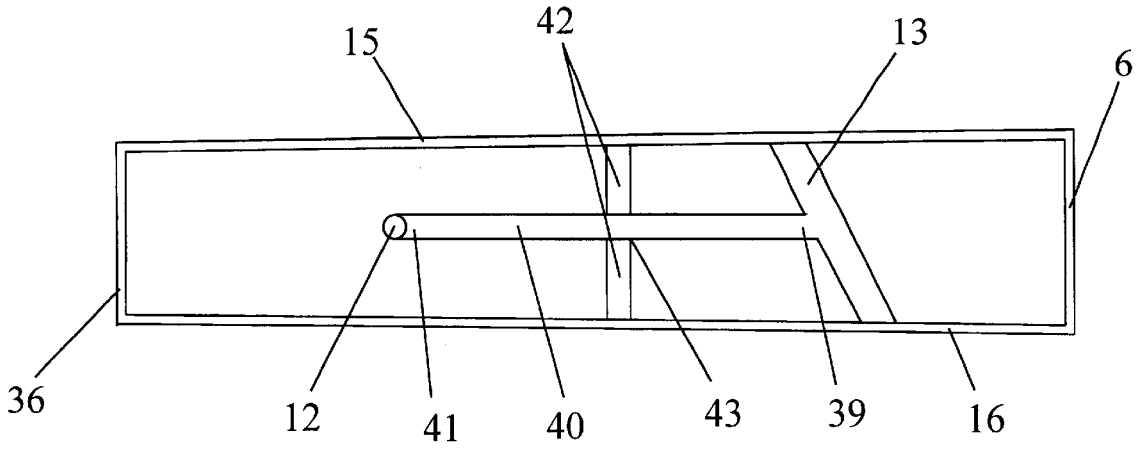
FIG. 11 is a view from above the embodiment of FIG. 10.

Further to assure that no tooth paste leaks from this alternative embodiment of the Tooth Brush with Reservoir, a central partition 42 having a central aperture 43 through which the rod 40 may slidably pass is connected to the top 10 of the body 2, to the bottom 14 of the body 2, to the first side 15 of the body 2, and to the second side 16 of the body 2. FIG. 10 is a cutaway view from the side of the body 2 illustrating the placement of the central aperture 43, which location is between the first end 19 of the linear aperture 8 and the first end 6 of the body 2 and is preferably near the first end 19 of the linear aperture 8. FIG. 11 is a similar view from above the body 2.

The Tooth Brush with Reservoir facilitates traveling since one need only pack a tooth brush and need not also include a separate container of tooth paste. Furthermore, the Tooth Brush with Reservoir enhances health when several people utilize the same container of tooth paste. After a desired quantity of tooth paste has been expelled from a standard container, the usual method for separating the selected quantity from that remaining within the container is to move the tips of the bristles on the tooth brush across the opening in the container. Of course, such bristles have usually been within the mouth of the one using the brush and are, consequently, likely to contain germs that are passed to the tooth paste remaining within the container. In the case of the Tooth Brush with Reservoir, however, it would probably be the first end 6 of the body 2 that is brushed across the opening in the container. And if the first end 6 of the body 2 has entered the mouth of a user, it will have been adjacent to the head 1 and, therefore, not have come into such direct contact with the mouth as have the bristles of a standard tooth brush.

I claim:

1. A tooth brush with reservoir, which comprises:

a head having bristles on the top of said head and having a male fitting;

a body having a first side and a second side, said body having a top and a bottom, said body having an aperture for removably attaching said body to said head, said body having a reservoir in communication with said aperture, and said body having a linear aperture communicating with the reservoir, said linear aperture having a first end and a second end;

a stem slidably mounted within the linear aperture of said body;

a tab attached to said stem outside said body;

a blade connected to said stem within said body, said blade having a top; and a foldable membrane having a first end attached to said body near a first end of said linear aperture, having a second end attached to said body near a second end of said linear aperture, and being attached to the top of said blade at an intermediate point along said foldable membrane.

2. The tooth brush with reservoir as recited in claim 1, wherein:

said foldable membrane extends from the first side to the second side of said body.

3. The tooth brush with reservoir as recited in claim 2, wherein:

said blade is constructed of resilient material; and said blade is angled so that said blade will always run from the top of said body to the bottom of said body even when the height of said body varies.

4. The tooth brush with reservoir as recited in claim 3, wherein:

said blade is angled so that said blade will always run from the first side of said body to the second side of said body even when the width of said body varies.

5. The tooth brush with reservoir as recited in claim 2, wherein:

said blade is constructed of resilient material; and said blade is angled so that said blade will always run from the first side of said body to the second side of said body even when the width of said body varies.

6. The tooth brush with reservoir as recited in claim 1, further comprising:

a membrane-holding channel attached to said body.

7. The tooth brush with reservoir as recited in claim 6, wherein:

said blade is constructed of resilient material;

said blade has a cutout to accommodate saide membrane-holding channel; and said blade is angled so that said blade will always run from the top of said body, except for the portion of said blade below the cutout, which portion will always run from said membrane-holding channel, to the bottom of said body even when the height of said body varies.

8. The tooth brush with reservoir as recited in claim 7, wherein:

said blade is angled so that said blade will always run from the first side of said body to the second side of said body even when the width of said body varies.

9. The tooth brush with reservoir as recited in claim 6, wherein:

said blade is constructed of resilient material; and said blade is angled so that said blade will always run from the first side of said body to the second side of said body even when the width of said body varies.

10. A tooth brush with reservoir, which comprises:

a head having bristles on the top of said head and having a male fitting;

a body having a first side and a second side, said body having a top and a bottom, said body having a first end and a second end, said body having an aperture for removably attaching said body to said head, said body having a reservoir in communication with said aperture, and said body having a linear aperture communicating with the reservoir, said linear aperture having a first end and a second end;

a stem slidably mounted within the linear aperture of said body;

a tab attached to said stem outside said body;

a rod, said rod having a first end and a second end, said rod further having the second end of said rod attached to said stem inside said body;

a blade, said blade having a top, attached to the first end of said rod at such a distance from said stem that when said stem is at the second end of the linear aperture, the top of said blade is between the first end of the linear aperture and the first end of said body; and a central partition connected to the top of said body, to the bottom of said body, to the first side of said body, and to the second side of said body, said central partition having a central aperture through which central aperture said rod slidably passes, and said central partition being located between the first end of the linear aperture and the first end of said body.

11. The tooth brush with reservoir as recited in claim 10, wherein:

said blade is constructed of resilient material; and said blade is angled so that said blade will always run from the top of said body to the bottom of said body even when the height of said body varies.

12. The tooth brush with reservoir as recited in claim 11, wherein:

said blade is angled so that said blade will always run from the first side of said body to the second side of said body even when the width of said body varies.

13. The tooth brush with reservoir as recited in claim 10, wherein:

said blade is constructed of resilient material; and said blade is angled so that said blade will always run from the first side of said body to the second side of said body even when the width of said body varies.

* * * * *